United States Patent [19]

Corbett

[11] 4,239,272

[45] Dec. 16, 1980

[54] RIGGING SLING WITH SEPARATOR

[76] Inventor: Gerald L. Corbett, c/o Fluor So. Africa, P. O. Box 505, Springs 1560 Transvaal, South Africa

[21] Appl. No.: 96,031

[22] Filed: Nov. 20, 1979

[51] Int. Cl.[3] ..... B66C 1/20

[52] U.S. Cl. ..... 294/74

[58] Field of Search ..... 294/74, 78 R, 112, 67 E, 294/67 EA, 67 BA, 82 R; 269/95; 254/192, 194, 195; 224/45 R, 45 A, 55, 58

[56] References Cited

U.S. PATENT DOCUMENTS

| | | | |
|---|---|---|---|
| 1,020,600 | 3/1912 | Ferguson | 294/74 |
| 1,242,636 | 10/1917 | Ankrom | 294/74 |
| 1,446,278 | 2/1923 | Swenson | 294/74 |
| 1,573,878 | 2/1926 | Smith | 294/74 |
| 1,670,333 | 5/1928 | Aldrich | 294/74 |
| 1,819,390 | 8/1931 | Seager | 294/74 |
| 2,573,216 | 10/1951 | Natoli | 294/74 |
| 3,042,441 | 7/1962 | Jeff et al. | 294/74 |
| 3,119,160 | 1/1964 | Hoppeler | 24/16 |
| 4,126,347 | 11/1978 | Hogu | 294/74 |

*Primary Examiner*—James B. Marbert

*Attorney, Agent, or Firm*—Harris, Kern, Wallen & Tinsley

[57] ABSTRACT

A rigging sling comprising a pair of sling members or lifting cables, and a separator member having a relatively stiff spreader cable pivotally connected to sleeves slidably positioned on each sling member. Each sling member has eyes at each end for receiving a lifting hook or the like. The spreader cable passes through an eye of each sling member. The sleeves include a hollow cylindrical shell positioned for sliding on the sling member between the eyes. In the preferred embodiment the spreader cable has a diameter approximately twice that of the sling cable members.

9 Claims, 4 Drawing Figures

RIGGING SLING WITH SEPARATOR

BACKGROUND OF THE INVENTION

This invention relates to rigging slings, and specifically to a sling with means for spreading or separating a pair of sling cables when used with one lifting hook.

Devices currently in use for separating or spreading lifting slings typically use a rigid bar fastened between the sling cables to separate them. However, use of a rigid bar presents many problems. While a long separator bar tends to reduce the chances of entanglement of the sling cables, it becomes very cumbersome when a worker attempts to use such a device since it is harder to control. On the other hand, when the bar is made shorter to increase the ease of operating the rig, the chances of the slings getting twisted or entangled around each other increases. Furthermore, a solid separator bar is not adaptable to various lifting requirements in terms of the distance between the points at which the lifting slings are attached to the load.

Conventional devices which do not adequately separate the sling cables also present the situation of workers having to stretch and reach for the hook while untangling the slings. This presents hazards and safety problems in that a worker could stumble in attempting to untangle the slings. Moreover, heavy loads are often involved and therfore the use of heavy hooks is required presenting a danger that the heavy hook or headache ball may strike and injure a worker attempting to free twisted lifting cables.

Various devices for lifting which feature a method of separating the slings are illustrated in the patent to Natoli, U.S. Pat. No. 2,573,216, and the patent to Smith, U.S. Pat. No. 1,573,878. The Natoli device for hoisting and lowering barrels, etc., utilizes two lifting cables having a spring secured at the lower ends of the lifting chains for bringing the ends together. The Smith patent shows a structure with rigid links and arms, with the arms connected by a cable which serves as a release member.

Other difficulties encountered with past devices for separating slings include lost production time associated with worker labor involved in untangling idle cables, as well as longer hook-up times. Furthermore, conventional separators are usually of significant weight, making rigging operations mor laborious and hazardous.

It is therefore an object of the present invention to construct a sling separator which serves to keep a pair of lifting cables from becoming tangled when hanging idle from one lifting hook. It is another object of the present invention to provide a rigging sling whcih permits a rigger to work at a greater distance from the hook or headache ball, and thus increase the working radius of the hook.

It is a further object of the present invention to construct a sling separator which overcomes any adverse reactions the wire rope slings may exhibit when put under stress of weight. Specifically, it is an object that the invention permit the sling to rotate freely when put under stress of a load. It is an object of the present invention to permit a variable distance of separation between the slings, and to allow the slings to swing freely to form an angle anywhere from approximately 0° to 180°. It is an object of the present invention to provide a sling separator which is flexible and movable to meet the many situations associated with rigging, while presenting only a slight increase of weight in the rigging hardware.

It is an object of the present invention to provide a faster hook-up and release time for the riggers, and to enable the riggers to work from a safe and comfortable position while completing their rigging assignment. Another object is to provide a device which allows for decreased time for each hook-up.

Another object of the present invention is to provide some additional footage of spread (length) down to the lower (working) slings, e.g.; slings fitted to cradle a box; slings fitted to reach the ends of a piece of pipe; slings to choke a bundle of pipe. This added footage of length delivered by the sling of the present invention will thus utilize shorter working slings representing an added cost savings in purchasing new slings.

SUMMARY OF THE INVENTION

The rigging sling of the present invention includes a pair of sling members or lifting cables each having first and second eyes at each end thereof, and a separator member having a spreader cable connected to a sleeve slidably positioned on each sling member. The spreader cable preferably passes through the first eye of each sling member, with the sling member preferably having the central axis of the first eye positioned perpendicular to the central axis of the second eye.

In the preferred embodiment, the spreader cable is substantially stiffer than the lifting cables and desirably has a diameter approximately twice that of the lifting cables. The sleeves preferably include a hollow cylindrical shell positioned for sliding on the sling cable member between the first eye and the second eye, and with each end of the spreader cable pivotally connected to the hollow shell. Other improvements include having a lubricating cup portion positioned within the sleeve to facilitate sliding action, and having the eyes rigidly fastened to the sling members by pressed fitting. Further optional features include a thimble located on the first eye to prevent chafing with the lifting hook, a thimble on the second eye to prevent chafing with various shackles and/or attachments thereof, as well as incorporating a soft portion onto the pressed fittings for hand grasping.

DESCRIPTION OF THE PREFERRED EMBODIMENT

Figure 1:
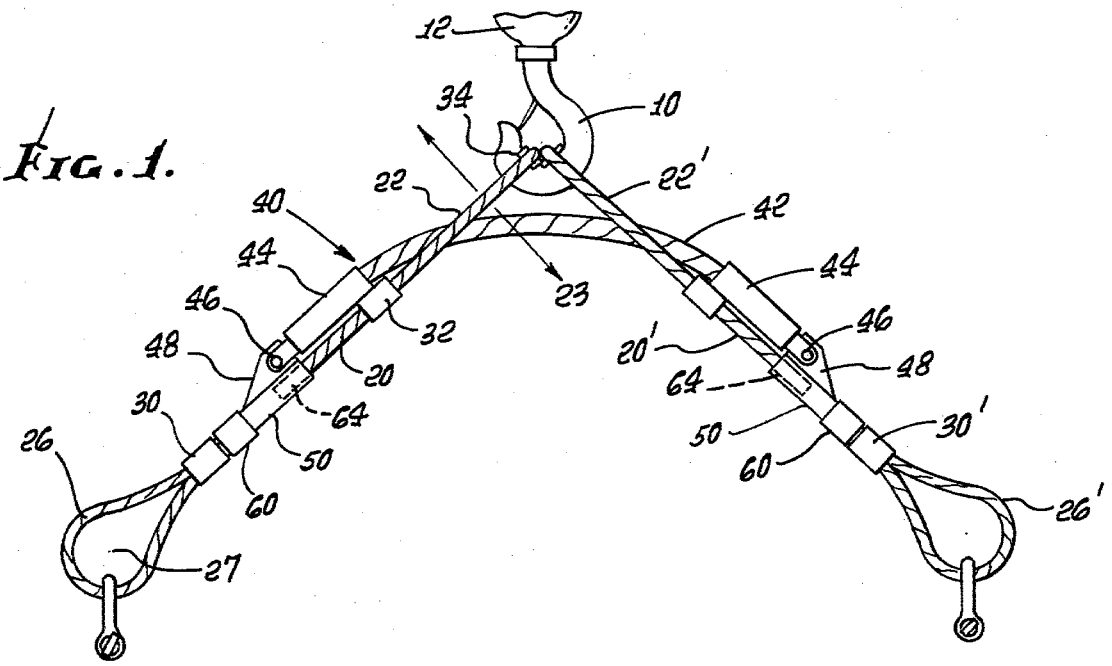
FIG. 1 is a front view of a sling with separator incorporating the preferred embodiment of the invention, as it would appear hanging freely from a lifting hook.
Figure 2:
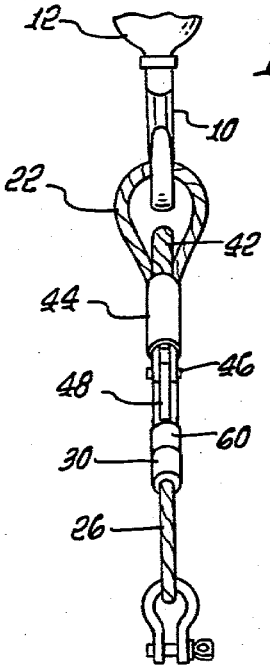
FIG. 2 is an end view of the sling of FIG. 1.

The sling shown in FIG. 1 hangs from a lifting hook 10 having a headache ball 12. A pair of sling members or lifting cables 20, 20' are made of cable or rope of suitable material such as wire. Each lifting cable has a first eye 22, 22' at one end for receiving the lifting hook, and a second eye 26, 26' at the other end for a hook, clevis, or the like. The first eye 22 has a central axis 23, and the second eye has a central axis 27. The eyes are rigidly fastened by pressed fittings 30, 32 such that the central axis of the first eye preferably is perpendicular to the central axis of the second eye. A crescent thimble 34 may be positioned inside the upper portion of the first eye to prevent chafing of the sling cable on the lifting hook.

A separator member 40 has a spreader 42, constructed of wire rope or cable which is flexible yet provides desired stiffness depending on its thickness and length. The spreader cable 42 has a fitting 44 attached at each end, and is pivotally connected by pin 46 to a sleeve 50. The sleeve 50 is a hollow cylindrical shell such as a pipe or tube, having a rib 48 thereon for pivotal attachment of the separator cable. The hollow shell is of sufficient diameter to allow it to slide freely on the sling cables between the eye fittings 30,30' and 32,32'.

The spreader cable lays on the upper surface of the sling cables and passes through the first eyes 22,22' of each sling cable. A portion of the hollow pipe may be covered with a soft material such as rubber hose 60 to facilitate comfortable handling by an operator, as well as to provide a better grip. The spreader cable 42 should be stiffer than the lifting or sling cables 20,20' and in the preferred embodiment, the diameter of the spreader cable should be approximately two times the diameter of the sling cables, in order to maintain separation of the sling cables and at the same time provide flexibility for use with a wide range of load sizes. A preferred dimension which has been found to give satisfactory results is a 6 × 19 spreader cable approximately $1\frac{1}{2}$ inches in diameter matched with 6 × 25 sling cables approximately $\frac{7}{8}$ inch diameter. With sling cables 4 feet long, this gives a separation at the lower portion of the second eye of each cable of approximately 7 feet when unloaded as shown in FIG. 1.

Figure 3:
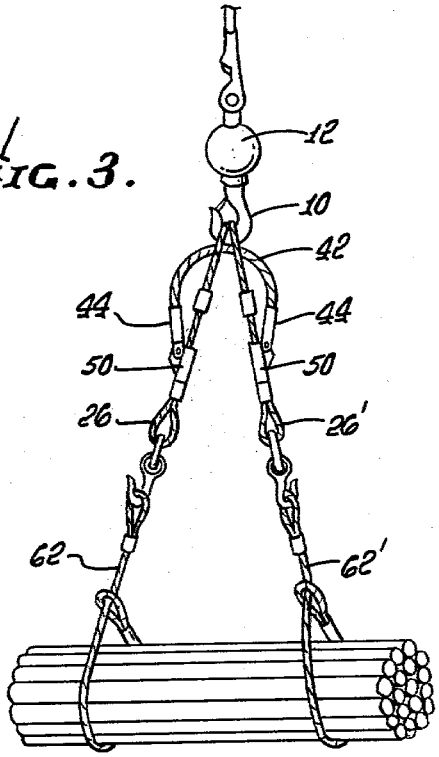
FIG. 3 is a perspective view of the sling of FIG. 1 in operation with the lower ends positioned close together.
Figure 4:
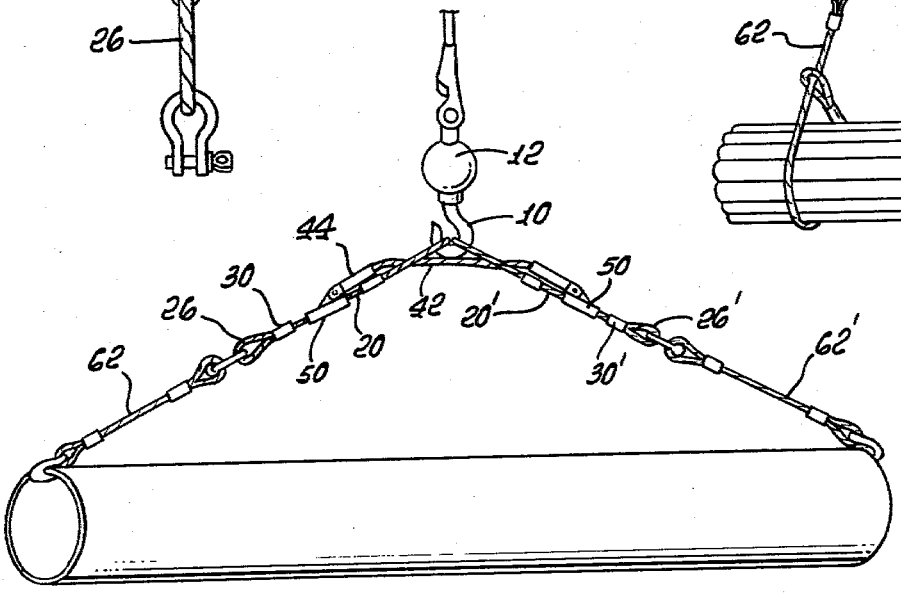
FIG. 4 is a view similar to that of FIG. 2, with the sling lifting a load requiring a wide angle or distance between the lower ends.

In operation, the sling separator is attached to the load at the lower portion of the second eyes 26,26', for example by connecting to cables 62,62' attached to the load. As shown in FIG. 3 the cables 62,62' may be positioned closer together approaching an angle of 0° between the two lifting cables, or may be positioned far apart as shown in FIG. 4, approaching an angle of 180°. As the sling cables are positioned for hooking to whatever load is to be hoisted, sleeves 50 are free to slide up and down the cables 20,20' between the eye fittings.

A lubricating cup 64 may be positioned within the sleeve to facilitate such sliding. In addition to the sliding motion of the sling cable through the sleeve, the sleeve permits sling cable 20 to rotate freely in response to a load, in accordance with the tendency of wire rope to spin in the opposite direction of the lay of the rope when it is put under tension. This is a major advantage when heavy loads are being hoisted.

Furthermore, as illustrated in the drawing, the positioning of the eyes of the sling cable at 90° at one another and the passage of the pivotally attached spreader cable through the first eye of each cable provides more natural movement of the slings when positioned from 0°°to 180° as required.

I claim:

1. A rigging sling for lifting objects, and comprising:
first and second lifting cables, each having eye means at each end for connection to a hook or the like;
first and second sleeves, with said first sleeve slidably carried on said first cable between said eye means thereof and with said second sleeve slidably carried on said second cable between said eye means thereof; and
a third cable connected at one end of said first sleeve and at the other end of said second sleeve.

2. A sling as defined in claim 1 with said third cable passing through an eye means of each of said first and second cables.

3. A sling as defined in claim 2 with said third cable pivotally connected to each of said first and second sleeves.

4. A sling as defined in claim 3 including a lubricating cup carried within each of said sleeves.

5. A sling as defined in claim 1 wherein said third cable is substantially stiffer than said first and second cables.

6. A sling as defined in claim 5 wherein said third cable has a diameter in the order of twice that of each of said first and second cables.

7. A sling as defined in claim 6 wherein each of said eye means is formed by rigidly fastening the end of the cable to a portion adjacent the end with a pressed fitting.

8. A sling as defined in claim 7 wherein each of said pressed fittings includes a soft portion for manual grasping.

9. A sling as defined in claim 7 wherein each of said fittings comprises a stop for limiting movement of the corresponding sleeve.

* * * * *